United States Patent [19]

Nagano

[11] Patent Number: 5,070,680

[45] Date of Patent: Dec. 10, 1991

[54] APPARATUS FOR OPENING A FLAT TUBE AND FITTING SAME ON A CONTAINER OR THE LIKE

[75] Inventor: Satoshi Nagano, Osaka, Japan

[73] Assignee: Fuji Seal Industry Co. Ltd., Osaka, Japan

[21] Appl. No.: 530,995

[22] Filed: May 31, 1990

[51] Int. Cl.[5] ..... B65B 53/02

[52] U.S. Cl. ..... 53/557; 53/292; 53/585

[58] Field of Search ..... 53/291, 292, 293, 399, 53/442, 557, 585, 48.2, 48.5; 156/86, 566, 294, 295, 310, 311, 312, 313, 314, 315, 316

[56] References Cited

U.S. PATENT DOCUMENTS

| | | | |
|---|---|---|---|
| 2,815,627 | 12/1957 | Eddison | 53/291 |
| 4,293,364 | 10/1981 | Fujio | 53/292 X |
| 4,354,333 | 10/1982 | McArdle | 53/585 X |
| 4,497,156 | 2/1985 | Scheidegger | 53/557 X |
| 4,519,186 | 5/1985 | Winter et al. | 53/292 X |
| 4,562,684 | 1/1986 | Dreher | 53/292 X |
| 4,562,688 | 1/1986 | Mueller | 53/292 X |
| 4,691,835 | 9/1987 | Mueller | 53/557 X |
| 4,914,893 | 4/1990 | Strub et al. | 53/585 X |

FOREIGN PATENT DOCUMENTS

| | | | |
|---|---|---|---|
| 18473 | 8/1969 | Japan . | |
| 122918 | 6/1987 | Japan . | |
| 2122966 | 6/1983 | United Kingdom | 53/585 |

*Primary Examiner*—Robert L. Spruill
*Assistant Examiner*—Daniel B. Moon
*Attorney, Agent, or Firm*—Koda and Androlia

[57] ABSTRACT

An apparatus for opening flatly folded tubes of synthetic resin or the like material and fitting same on containers or the like objects. Operation of fitting opened tubes on the objects can be performed without requiring any complicated movement of the objects. Each opened tube and each object are transported in same direction and, in the course of this transport, either the tube or the object is moved gradually toward the other so that the one is fitted on or inserted into the other.

6 Claims, 5 Drawing Sheets

APPARATUS FOR OPENING A FLAT TUBE AND FITTING SAME ON A CONTAINER OR THE LIKE

BACKGROUND OF THE INVENTION

1. Field of the Invention

This invention relates to an apparatus for opening a flatly folded tube of synthetic resin or the like material and fitting same on a container or the like.

2. Description of the Background Art

Examples of prior art apparatuses of this type are shown in Japanese Patent Application Laid-Open No. 62-122918 and Japanese Patent Publication No. 44-18473, both covering apparatuses developed by the present applicant prior to this application.

These prior art apparatuses are of such arrangement that, as FIG. 7 shows, two horizontally opposed suction belts 2, 2*a* are spaced so that the distance between them becomes larger toward leading ends of the belts, whereby a flat tube 5 is progressively spread and opened as it is transported by the belts 2, 2*a* while being held at opposite sides thereof against the belts by suction. Below the space between the pair of belts 2, 2*a*, as FIG. 7(*b*) shows, there is provided a holder-carrier device 30 for effecting ascent and descent and horizontal movement of an object 8 such as a container.

According to such arrangement, an object 8 supplied to a position below the opened tube 5 is elevated and inserted into the tube 5, which is then transported forward until the tube 5 is separated from the belts 2, 2*a*, whereby the tube 5 is fitted over the object 8.

Such arrangement permits easy spreading and opening of flat tubes in the course of transport thereof and, as compared with other known arrangement such that a flat tube is spread and opened by means of a mandrel to a configuration conforming to the shape of the object to be wrapped, the arrangement is advantageous in that the apparatus is relatively simple in construction.

With the aforementioned prior art arrangement, however, one drawback is that since the insertion of each object 8 into an opened tube 5 is carried out through ascent and descent, as well as horizontal movement, of the object 8 by means of the holder-carrier device 30, a very complicated mechanism is required for drive control of the holder-carrier device 30 for such ascent and descent and horizontal movement, which leaves much yet to be improved with respect to the holder-carrier device 30 from the standpoints of ease of manufacture and manufacturing cost economy.

Another drawback is that the track of movement of the object 8 such that the object 8 is moved vertically upward and then moved horizontally does not permit smooth movement and is therefore unsuitable for use where high speed operation is required.

A further drawback is that the arrangement in which the object 8 is moved upward from a location immediately below the opened tube 5 for insertion thereof into the tube 5 does not permit accurate insertion, unless the tube 5 is held open substantially wider relative to the external size of the object 8. Moreover, as a matter of reality, the tube 5 as spread and opened by and between the belts 2, 2*a* can hardly be in round open condition and is usually opened in somewhat flatly deformed fashion. Where the diameter of the tube 5 is not so much different from the outer diameter of the object 8, therefore, the tube 5 and the object 8 may interfere with each other at the moment of the object 8 being inserted into the tube 5, which poses a problem in terms of insertion accuracy.

SUMMARY OF THE INVENTION

It is a primary object of the invention to eliminate the necessity of moving an object to be wrapped through a complicated process of movement including vertical and horizontal movement and to enable accurate fitting of an opened tube over the object by a simplified apparatus and process of operation.

The invention is directed to solving the aforementioned problems with the prior art by fitting the tube and the object into engagement with each other by moving one of them gradually toward the other while the tube and the object are transported in same direction.

According to a first aspect of the invention there is provided an apparatus for opening a flat tube and fitting same on a container or the like, comprising a pair of cyclically moving members 2, 2*a* operative to spread and open flat tubes 5 successively while transporting the tubes 5 by holding them at opposite side portions thereof, and a transport device 7 disposed below said pair of cyclically moving members 2, 2*a* for transporting objects 8 to be wrapped in same direction as that in which the flat tubes 5 are transported by said cyclically moving members 2, 2*a*, said cyclically moving members being forwardly down-sloped to enable individual opened tubes 5 to be moved successively toward individual objects 8 for being fitted thereon from above as the objects 8 are transported by the transport device 7.

According to a second aspect of the invention there is provided an apparatus for opening a flat tube and fitting same on a container or the like, comprising a pair of cyclically moving members 2, 2*a* operative to spread and open flat tubes 5 successively while transporting the tubes 5 by holding them at opposite side portions thereof, and a transport device 7*a* disposed above said pair of cyclically moving members 2, 2*a* for transporting objects 8 to be wrapped while supporting them at top side in same direction as that in which the flat tubes 5 are transported by said cyclically moving members 2, 2*a*, said transport device 7*a* having a transport path comprising a forwardly down-sloped portion C for enabling individual objects 8 to be moved successively toward individual tubes 5 for being inserted thereinto from above as the tubes 5 are opened while being transported by the cyclically moving members 2, 2*a*.

According to a third aspect of the invention, in the apparatus of the second aspect, instead of the provision of said forwardly down-sloped portion C in the transport path, said cyclically moving members 2, 2*b* being forwardly up-sloped to enable individual opened tubes 5 to be moved successively toward individual objects 8 for being fitted thereon from below as the objects 8 are transported by the transport device 7*a*.

In the foregoing arrangement of the first aspect, individual tubes 5, transported and opened by the cyclically moving members 2, 2*a* arranged above the transport device 7 in forwardly down-sloped fashion, are moved successively toward individual objects 8 as they are transported forward, so that the tubes 5 are individually fitted over the objects 8 from above. Thus, operation of such fitting can be performed without requiring such complicated process for transport of individual objects 8 as that employed in the prior art which involves ascent and descent, as well as horizontal movement, of the objects 8.

The respective paths of movement of the tubes 5 and of the objects 8 are codirectional, and each tube 5 while being spread and opened is gradually moved downward for being fitted on each corresponding object 8. This permits accurate partial fitting of the tube 5 on a top portion of the object 8 at an intial fitting stage, even when the tube 5 is not wide open. The tube 5 continues to move downward further after the initial fitting thereof on the top of the object 8 and accordingly the tube 5 is fitted on the object 8 as it is opened wider while being guided along the outer periphery of the object 8. Therefore, fitting operation can be accurately performed without possible hand-up or the like trouble with the tube 5 relative to the object 8.

According to the arrangement of the second aspect, individual objects 8, as they are transported along the forwardly down-sloped portion C of the transport device 7*a* disposed above the cyclically moving members 2, 2*a*, are moved successively toward individual tubes 5 being opened in their travel below the path of the objects 8 and are thus individually fitted into the tubes 5 from above.

According to the arrangement of the third aspect, individual tubes 5 opened as they are transported by the forwardly up-sloped cyclically moving members 2, 2*a* disposed below the transport device 7*a* are moved successively toward individual objects 8 being transported by the transport device 7*a* and are fitted on the objects 8 from below.

Therefore, the arrangement according to either the second aspect or the third aspect enables successful insertion or fitting without requiring each object 8 to be passed through such a complicated process of movement as required in the prior art, including ascent and descent and horizontal movement. The object 8, with its bottom positioned opposite to the mouth of a tube 5 being spread and opened, is partially inserted downward into the tube 5 and is then lowered relative to the tube 5 as the tube 5 is further spread and opened along the outer periphery of the object 8. This insures accurate insertion of the object 8 into the tube 5.

As described above, the apparatus of the invention comprises a pair of cyclically moving members operative to spread and open flat tubes while advancing the tubes, and a transport device provided below or above the cyclically moving members for transporting objects to be wrapped in same direction as the direction in which the flat tubes are transported, the track of movement of the transport device or that of the cyclically moving members being inclined in such fashion that the one gradually approaches the other, so that individual objects can be inserted successively into individual tubes from above as the latter is spread and opened while being advanced. Therefore, fitting operation with respect to the tubes relative to the objects can be performed without requiring such complicated process of movement of the objects as involved in the prior art, including ascent and descent and horizontal movement. Such arrangement means simplified construction of the transport device, which insures considerable reduction in the manufacturing cost of the apparatus. The arrangement permits smoother transport of the objects and, additionally, it facilitates synchronous operation of the transport device and cyclically moving members, which means that the apparatus can suitably be employed for high speed operation.

Moreover, according to the invention, in which each tube and each object to be wrapped, in corresponding relation, are transported in same direction and, in the course of such transport, one of the two is gradually fitted on or inserted into the other from above, even if the tube is not wide open at an initial stage of tube fitting relative to the object, operation for inserting the object into the tube involves no such difficulty as has been encountered with the prior art arrangement in which the object is inserted into the tube from a direction perpendicular to the direction of transport of the tube, it being possible to effect accurate partial fitting of the tube relative to a portion of the object. The tube allows the object to be further inserted thereinto as it is further spread and opened while being guided along the outer periphery of the object. This insures accurate tube fitting. Thus, the invention provides considerable improvement in tube fitting accuracy over the prior art arrangement and has an additional advantage that the tube can be properly fitted on the object even if it is a small-diameter tube having no much difference in size from the object.

The apparatus of invention is also advantageous in that it is well adaptable for any change in the size of the object to be wrapped or the position for tube fitting, by suitably changing the distance between the leading ends of the cyclically moving members and/or the level of the track of transport of the cyclically moving members or of the transport device for transport of objects, or otherwise, which fact adds to the practical applicability of the invention.

DETAILED DESCRIPTION OF THE PREFERRED EMBODIMENTS

Preferred embodiments of the invention will now be described.

(EMBODIMENT 1)

Figure 1:
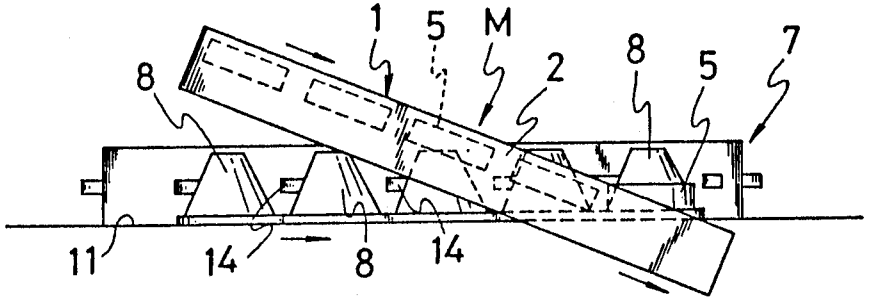
FIG. 1 illustrates a first embodiment of the invention, wherein (a) is a side view; (b) is a plan view, and (c) is a plan view of a device for spreading and opening and transporting tubes.
Figure 1:
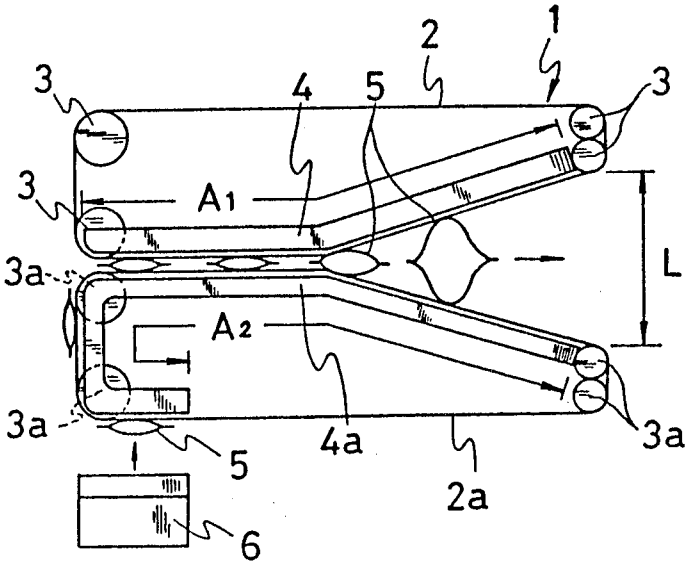
Figure 1:
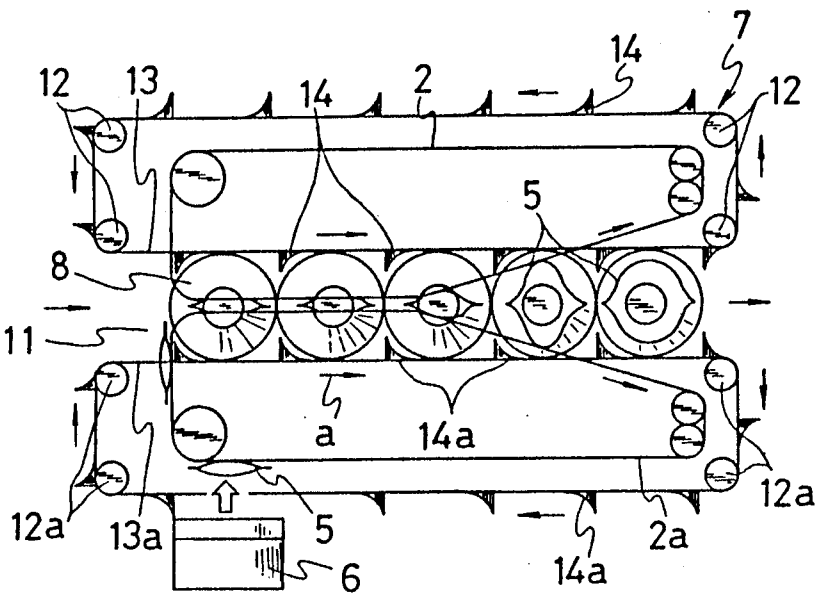

In FIG. 1, numeral 7 designates a transport device for transporting containers 8 (objects to be wrapped) on and along a horizontal path 11. The transport device 7 comprises a pair of side belts 13, 13*a* guided by a plurality of pulleys 12, 12*a* for cyclical movement in horizontal directions, the side belts 13, 13*a* being disposed in opposed relation across a transport path 11. The side belts 13, 13*a* are provided respectively with attachements 14, 14*a* which project from respective outer sides of the side belts 13, 13*a* at a plurality of locations spaced at a predetermined pitch, and which are adapted to abut rear sides of individual containers 8 supplied onto the transport path 11 to successively push the containers 8 forward. Therefore, the transport path 11 need not necessarily have a function to positively transport the containers, but it may be comprised of a drive belt of a belt conveyor or the like.

Above the transport device 7 there is provided a device 1 for transporting and opening flat tubes 5, which device 1 will be described below.

In FIG. 1 (*c*), 2, 2*a* designate a pair of cyclically movable suction belts (which correspond to cyclically moving members) with air permeability which are arranged in opposed relation and guided by a plurality of pulleys, the belts 2, 2*a* being spaced so that the distance L between them is small at an upstream portion thereof and becomes wider toward leading ends thereof. The belts 2, 2*a*, as shown in FIG. 1 (*a*), are forwardly down-sloped so that their forward end portions are positioned across the container transport path 11 of the transport device 7 in straddling fashion.

Inside the suction belts 2, 2*a* are respectively provided vacuum suction chambers 4, 4*a* operative to apply vacuum force of suction through the air permeable belts 2, 2*a* over respective ranges $A_1$ and $A_2$ shown. A feeder unit 6 for supply of flat tubes 5 is disposed beside the one suction belt 2*a*, the feeder unit 6 being such that after a continuous tube is cut by a cutter into pieces of desired size, the cut tubes are supplied onto the belt 2*a* for being sucked onto the outer surface of the latter.

The arrangement of the embodiment having now been described, the manner of operation will be explained by way of example.

Desired flat tubes 5 having prints or the like suitably applied thereto are first supplied successively by the feeder unit 6 onto the outer surface of the one suction belt 2*a* of the tube opening and transport device 1 at predetermined intervals for being held in suction thereagainst so that the tubes 5 are delivered into the space between the pair of belts 2, 2*a*. The flat tubes 5 are then held in suction at opposite sides by and between the two belts 2, 2*a* and are progressively spread and opened as they are transported forward (in the direction of arrow a). The suction belts 2, 2*a* are forwardly down-sloped as shown in FIG. 1 (*a*), and accordingly individual tubes 5 are gradually moved downward toward individual containers 8 transported on the transport device 7 at the predetermined pitch so that the tubes 5 are individually fitted on the containers 8.

At an initial stage of the process of each tube 5 being fitted on a container 8, the tube 5 partially fits on a top portion of the container 8 as may be seen at M in FIG. 1 (*a*), and therefore accurate fitting can be achieved even if the tube 5 is not wide open. Subsequently, as the tube 5 is opened wide while being transported forward, the tubes 5 is further fitted on the container 8 toward a larger diameter portion thereof while being guided along the outer periphery of the container 8. This insures more accurate tube fitting.

Both each tube 5 and each container 8 are transported in same direction, and the tube 5 is gradually moved downward toward the container 8 for being fitted on the latter from above. Therefore, the movement of the tube 5 can easily be synchronized with that of the container 8 and, even during high speed operation, the tube 5 can be accurately fitted on the container 8.

After each tube 5 is satisfactorily fitted on a container 8, the tube 5 as is fitted on the container 8 is transported forward by the transport device 7 for transfer to a next following stage. At the next stage, the process of, for example, heat shrinking the tube 5 for bringing it into bond with the side of the container 8 is carried out.

It can be arranged that holding in suction of each tube 5 by the belts 2, 2*a* is released at a position at which the process of fitting of the tube 5 on the corresponding container 8 ends. Through such arrangement it is possible to smoohly effect shifting of the tube 5 toward the container 8. Such arrangement can readily be adjusted by suitably setting the position of the chambers 4, 4*a* operative to apply vacuum force through the belts 2, 2*a*. If the tube 5 is still held in suction against the belts 2, 2*a* at the end of the process of tube fitting, the tube 5 can readily be separated from the belts 2, 2*a* through the force of transport for the container 8, with no inconvenience being caused to the process of fitting tubes 5.

(EMBODIMENT 2)

In the above described embodiment, each tube 5 is fitted on each corresponding container 8 to the bottom thereof. Where the tube 5 is used as a shrink label or the like, however, there may be cases where it is desired that the tube 5 should be partially fitted on the container 8, for example, only on an upper portion thereof. The present embodiment is suitably applicable in such case.

Figure 2:
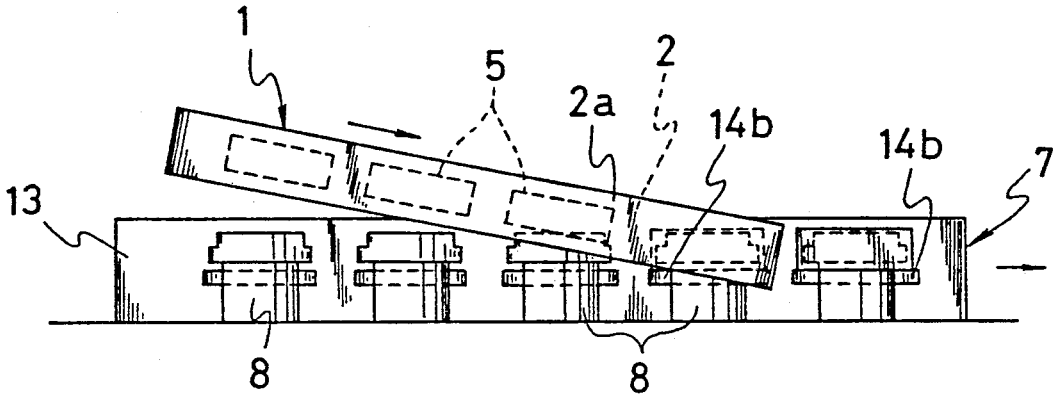
FIG. 2 illustrates a second embodiment of the invention, wherein (a) is a side view; and (b) is a plan view.
Figure 2:
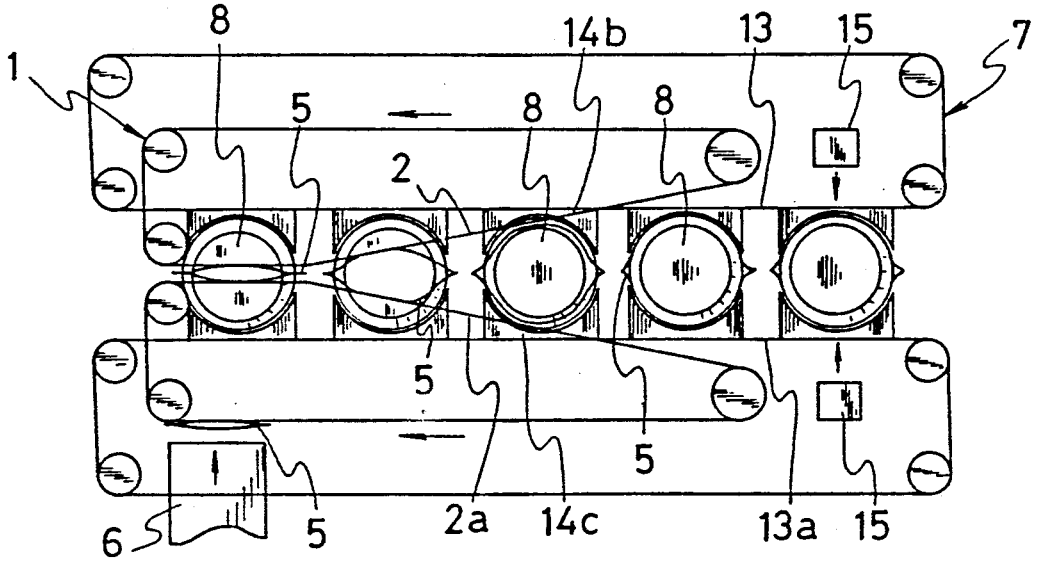

The apparatus shown in FIG. 2 is identical in fundamental features with the apparatus of Embodiment 1 (therefore, devices and parts similar to those of Embodiment 1 are designated by like reference characters, which applies to other embodiments as well).

Attachments 14*b*, 14*c* projecting from side belts 13, 13*a* of a transport device 7 for transport of containers are adapted to abut containers 8 at a predetermined level to enable the containers 8 to be transported forward. Heating units 15, 15 for heater-heating or hot-air heating are provided downstream of the exit-side end of suction belts 2, 2*a*.

According to the arrangement of the present embodiment, when each tube 5 spread and opened between the suction belts 2 and 2*a* is fitted on a corresponding container 8, the tube 5 is stopped by attachments 14*b*, 14*c* so that it is not allowed to descent to the level of the bottom of the container 8. When, after fitting of the tube 5 has ended, the tube 5 is heat-shrunk through heating by the heating units 15, 15, being then brought into bond with an upper portion of the container 8. Thus, the tube 5 is no longer liable to drop toward the bottom of the container upon subsequent movement of the attachments 14*b*, 14*c* away from sides of the container 8. Accordingly, the container 8 with the tube 5 as fitted in position on the upper portion of the container 8 can be supplied to a next following operating stage.

Figure 3:
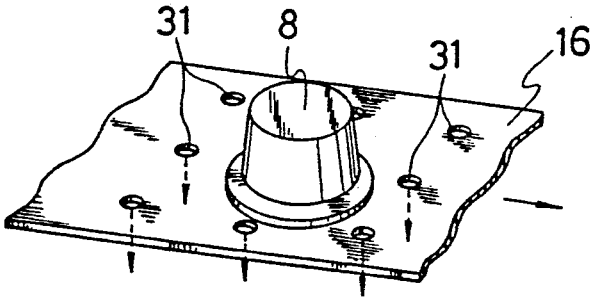
FIG. 3 is a fragmentary perspective view showing another form of transport device for transporting objects to be wrapped.

In the first and second embodiments described above, the transport device for container transport is constructed as a conveyor provided with attachments for pushing containers forward. However, the construction of the transport device 7 in the invention is not limited to that shown in the embodiments. For example, the transport device 7 may be in the form of a general-purpose conveyor having no side belt or the like, such that containers 8 are loaded and carried forward on the conveyor. However, for the purpose of transporting light-weight containers, it is desirable from the standpoint of practical applicability to employ a transport device having a positioning function for containers 8 so as to prevent possible deviation in container 8 positioning. For such transport device, one as shown by way of example in FIG. 3 may be employed such that containers 8 are transported while being held in suction on a belt 16 provided with venting holes or the like for application of vacuum suction force.

Where a tube 5 is partially fitted on an upper portion of a container 8, attachements 14*b*, 14*c* for stopping tubes 5 as in the above mentioned embodiment can be employed which concurrently serve for the transport of containers. This arrangement is desirable from the standpoints of apparatus streamlining and simplification, but it is understood that the invention is not limited by such arrangement. For example, the attachments 14*b*, 14*c* may be separate from the container transport device 7 and, without their being used for clamping containers, they are transported synchronously with containers 8 so that the attachments 14*b*, 14*c* are used only for the purpose of stopping tubes 5. It is noted that for the purpose of stopping tubes 5, the attachments may be arranged at spaced locations corresponding to front and rear sides of individual containers 8, irrespective of whether or not they are abuttable in relation to the containers 8. The configuration of such attachments is not limited in any way. There is no particular limitation with respect to drive means for the attachments. Such attachments may be provided at locations corresponding to any one of the following positions: front, rear, or side of each container 8. Depending upon the shape of each container 8 and the tube fitting position with respect to the container 8, such attachment need not necessarily be provided. Where no such attachment is provided, the side belts 13, 13*a* can perform the function of the attachments as each tube 5 fitted on a container 8 is placed on edge portions of the side belts 13, 13*a*.

(EMBODIMENT 3)

Nextly, a third embodiment of the invention will be explained with reference to FIG. 4.

Figure 4A:
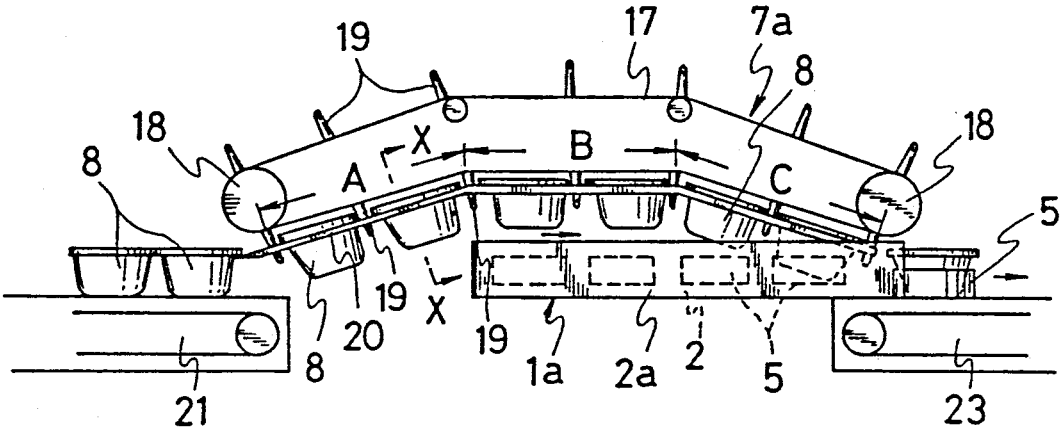
FIG. 4 illustrates a third embodiment of the invention, wherein (a) is a side view; (b) is a plan view; and (c) is a section taken along line X—X in (a)
Figure 4B:
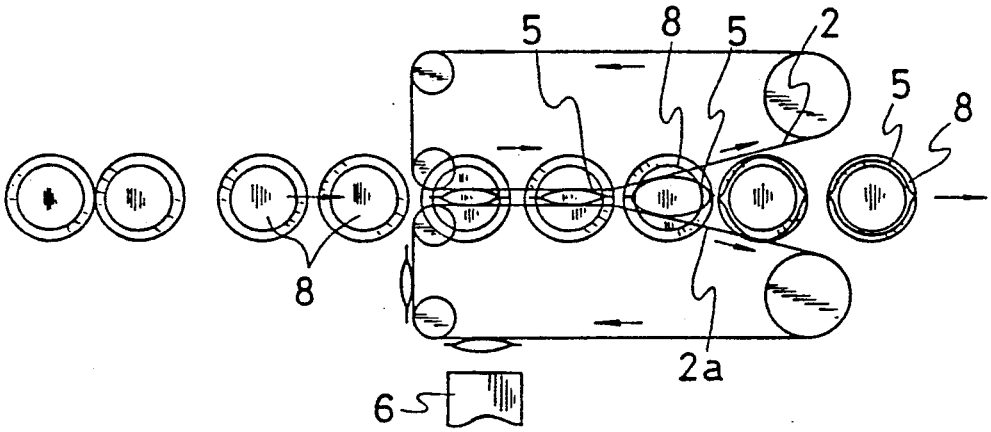
Figure 4C:
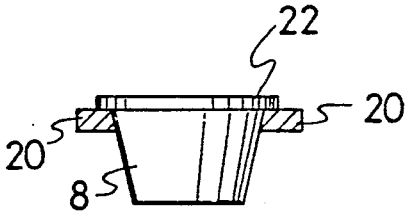

In FIG. 4, 1*a* designates a device for opening and transporting flat tubes, which is identical with the like device of Ebodiment 1 except that the belts 2, 2*a* for tube transport and opening are horizontally arranged.

Shown by 7*a* is a container transport device provided above the belts 2, 2*a*. Numeral 17 designates a drive chain which is cyclically driven while being guided by a plurality of pulleys 18 . . . of the transport device 7*a*. The underside track of the drive chain 17 has an up-sloped portion A, a horizontal portion B, and a forwardly down-sloped portion C. The drive chain 17 has on its outer surface side a plurality of outwardly projecting push pieces 19 arranged at a predetermined pitch. Container support guides 20 are provided in parallel relation to the underside track of movement of the drive chain 17. As FIG. 4(*c*) shows, each of the support guides 20 serves to lock and support a collar portion 22 formed on the top of each container 8.

According to the arrangement of this embodiment, containers 8 supplied onto a feed conveyor 21 can be transported along the support guides 20 by being pushed by means of the push pieces 19 of the transport device 7*a*. In that case, the bottom side of each container 8 is in non-supported condition.

After each container 8 has reached the forwardly down-sloped portion C, the container 8 is lowered as it is advanced, so that the container 8 is gradually inserted into a tube 5 therebelow which is being opened and transported between the suction belts 2, 2*a*.

In this tube fitting operation, as in the foregoing Embodiment 1, each tube 5 and each container 8 are transported in same direction. Further, the container 8 is gradually inserted into the tube 5 from above. Therefore, the movement of the tube 5 and that of the container 8 can easily be synchronized. Although the tube 5 is not wide open at an initial stage of the process of the container 8 being inserted into the tube 5, accurate insertion can be effected, because the container 8 is only partially inserted at its bottom side into the tube 5. Subsequently, as the tube 5 is transported forward and opened wide, a larger-diameter portion of the container 8 is properly inserted downward into the tube 5. In this case, the tube 5 can be fitted in position as it is opened by being guided along the outer periphery of the container 8, which insures accurate completion of fitting operation.

Upon completion of the insertion of the container 8 into the tube 5, the tube-fitted container 8 is pushed forward by push pieces 19 on the transport device 7*a*, being thereby loaded onto a separately provided discharge conveyor 23, which in turn delivers the tube-fitted container 8 to a next following stage of operation.

In the above described embodiment, the transport device 7*a* has an up-sloped portion A. This enables receiving supply of containers 8 from the feed conveyor 21 installed at a substantially same level as the suction belts 2, 2*a*, and further permits a series of conveyors 21, 23 to be arranged at substantially same level. In this way, the provision of such portion A is desirable from the standpoint of operational convenience. However, such means is not an essential part of the invention and may be provided as required.

The construction of the transport device 7*a* is in no way limited to the above described one. Where the container 8 has no collar portion 22, for example, a conveyor for transporting such container 8 while holding a top portion thereof under vacuum suction may be employed. Any such change in design may be made as desired. There is no limitation as to the slope, size, and other details of the forwardly down-sloped portion C. The entire track range for transport of containers 8 on the transport device 7*a* may be inclined so that it consists entirely of a sloped portion C.

(EMBODIMENT 4)

Figure 5:
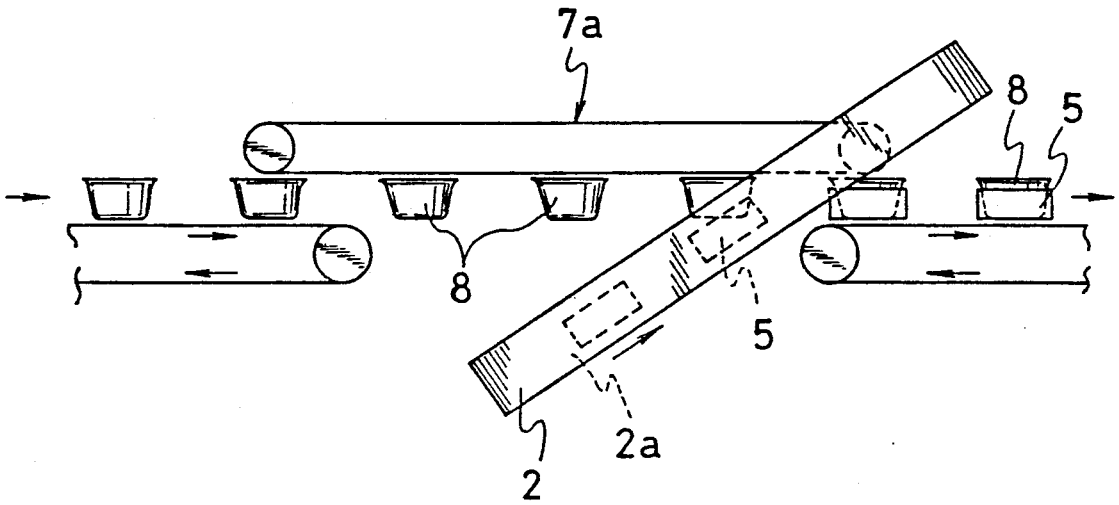
FIG. 5 is a side view showing a fourth embodiment of the invention.

This embodiment is a modified form of the above described Embodiment 3 and will be explained with reference to FIG. 5.

A transport device 7*a* is designed to transport containers 8 while holding them at the top thereon. The transport track of the device 7*a* has no sloped portion and accordingly containers 8 are horizontally transported. Cyclically moving members 2, 2*a* arranged below the transport device 7*a* are forwardly up-sloped.

In this embodiment, tubes 5 as opened while being transported by the cyclically moving members 2, 2*a* are moved gradually upward toward the containers 8 for being fitted on the containers 8 from the bottom side thereof. Therefore, just as seen in the above described Embodiment 3, the present embodiment permits accurate fitting without requiring any complicated process of transport for tubes 5 and containers 8.

(OTHER EMBODIMENTS)

In the foregoing embodiments, suction belts 2, 2*a* operative to apply vacuum suction force are employed as means for transporting and opening tubes 5. However, it is understood that the invention is not limited by such belts. A device in which a holder having a vacuum suction function as disclosed in Japanese Patent Publication No. 44-18473 shown as an example of the prior art is cyclically movable may be employed, for example. Of course, other suitable means may be used. It is only necessary that the device comprises a pair of opposed cyclically moving members 2, 2*a* operative to spread and open flat tubes 5 while transporting the tubes 5 by holding them at opposite side portions thereof.

In the foregoing embodiments, the object for tube fitting is exemplified by a container. However, the scope of application of the invention is not limited to such kind of object, and the invention may be applicable to various other kinds of objects. Likewise, various kinds of flat tubes 5 may be used, and they are not limited to shrink labels or cap seals of the heat shrink type.

According to the invention, where the cyclically moving members 2, 2*a* for transporting and opening flat tubes 5 are forwardly down-sloped, not entire track range of tube transport of the cyclically moving members 2, 2*a* must be sloped, as is the case with the foregoing Embodiment 3 in which the transport device 7*a* for transport of object 8 has a forwardly down-sloped portion C. For example, even where the cyclically moving members 2, 2*a* have a non-sloped portion for horizontal transport on the upstream side of the transport track, the arrangement comes under the technical scope of the invention, if the cyclically moving members 2, 2*a* have a down-sloped portion on the downstream side.

Figure 6:
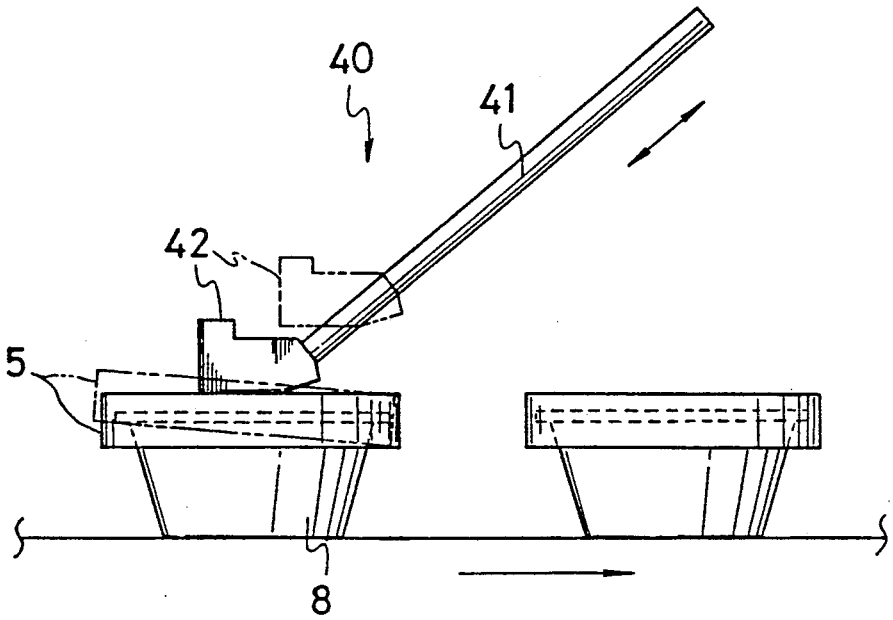
FIG. 6 is an explanatory fragmentary view showing a tube forcing device in another embodiment of the invention.
Figure 7A:
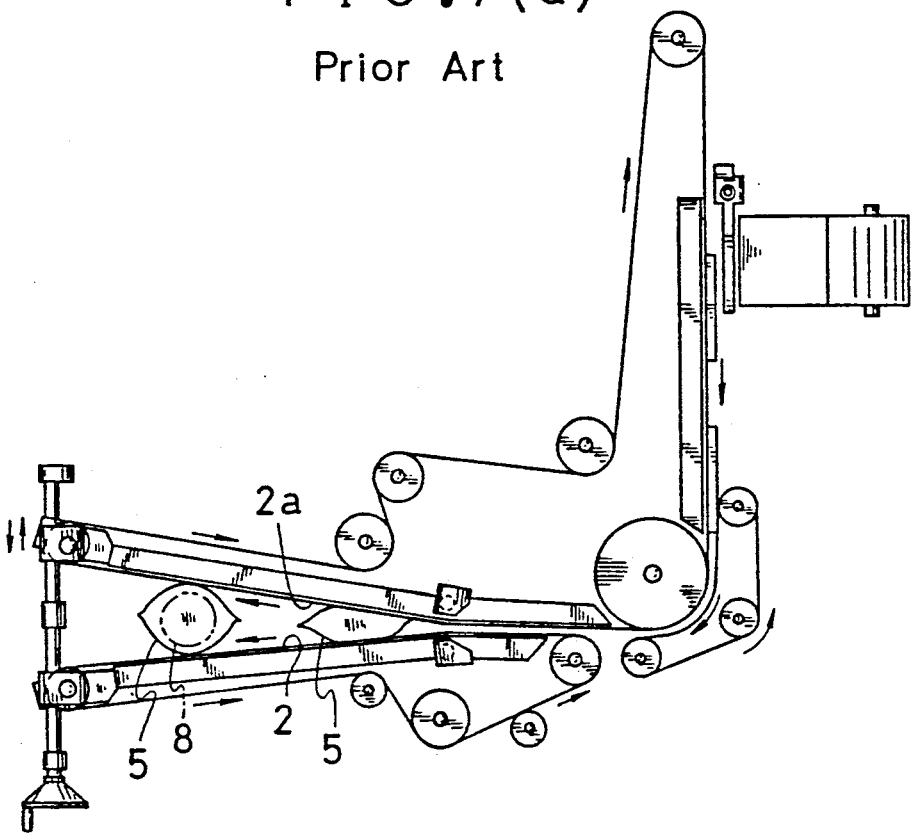
FIG. 7(a) Prior Art
FIG. 7 illustrates a prior art arrangement, wherein (a) is a plan view; and (b) is a fragmentary side view.
Figure 7B:
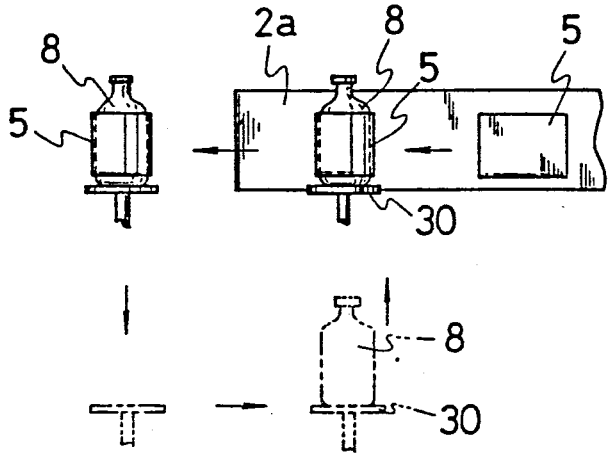
FIG. 7(b) Prior Art

Further, it is possible to provide a forcing unit 40, as shown in FIG. 6, for forcing a tube 5 fitted on each object 8 into position relative to the object at a downstream location in the device 1 for transporting and opening flat tubes. The forcing unit 40 has an up and down movable arm 41 positioned above the object, the arm 41 being provided at its lower end with a pad 42 adapted to abut the top of the tube 5 fitted on the object 8 for forcing the tube down. Through the provision of such forcing means it is possible to achieve more accurate fitting of the tube 5 in position relative to the object, even if the tube 5 is not properly positioned when it is fitted on the object 8.

Various changes in design may be made as desired with respect to the details of the arrangement of parts, within the spirit and scope of the invention. There is no limitation whatever as to means for feeding tubes 5 to the cyclically moving members 2, 2*a*. The provision of heating units 15 for heat-shrinking tubes 5 passed through the process of tube fitting relative to objects 8 is, needless to say, applicable to only such partial tube fitting operation as exemplified in the foregoing Embodiment 2.

What is claimed is:

1. An apparatus for opening a flat tube and fitting same onto an individual container comprising a pair of cyclically moving members for successively spreading and opening flat tubes while transporting said tubes by holding them at opposite side portions thereof and a transport device provided under said pair of cyclically moving members for horizontally transporting said individual containers in the same direction as said flat tubes being transported by said cyclically moving members, wherein inner sides, that face each other, of said pair of cyclically moving members comprise a transfer section in which said cyclically moving members move in parallel relationship and a spread section in which said members diverge from one another in relation to the transport direction of the containers, said spread sections of said cyclically moving members being provided such that said spread sections are inclined downwardly in said transport direction so that said spread sections are on both sides of and straddle over said individual containers, thus fitting said tubes, which have been opened by said cyclically moving members, onto said individual containers from above.

2. An apparatus for opening a flat tube and fitting same on a container as set forth in claim 1, wherein attachments capable of stopping individual tubes fitted on corresponding containers are arranged along the path of transport of the containers at opposite sides thereof for arresting the descent of the tubes at a desired level relative to the containers, said attachments being movable in synchronism with the containers.

3. An apparatus for opening a flat tube and fitting same on a container as set forth in claim 1 or 2, wherein there are provided forcing means for forcing the tubes fitted on the containers into position relative to the containers.

4. An apparatus for opening a flat tube and fitting same on a container as set forth in claim 3, wherein heating means for heating tubes to cause them to shrink are disposed in the stage of transport of the containers, downstream of the position at which the process of fitting is completed with respect to each container and a corresponding tube as opened and transported by the cyclically moving members.

5. An apparatus for opening a flat tube and fitting the same onto an individual container comprising a pair of cyclically moving members for successively spreading and opening flat tubes while transporting said tubes by holding them at opposite side portions thereof and a transport device provided above said pair of cyclically moving members for horizontally transporting said individual containers in the same direction as said flat tubes being transported by said cyclically moving members, wherein inner sides, that face each other, of said pair of cyclically moving members comprise a transfer section in which said cyclically moving members move in parallel relationship and a spread section in which said members diverge from one another in relation to the transport direction of the containers, said spread sections of said cyclically moving members being mounted such that said spread sections are inclined upwardly in said transport direction so that said spread sections are on both sides of said individual containers, thus fitting said tubes, which have been opened by said cyclically moving members, onto said individual containers from below.

6. An apparatus for opening a flat tube and fitting same on a container as set forth in one of claim 2 or 5, wherein heating means for heating tubes to cause them to shrink are disposed in the stage of transport of the containers, downstream of the position at which the process of fitting is completed with respect to each container and a corresponding tube as opened and transported by the cyclically moving members.

* * * * *